US007698972B2

(12) United States Patent
Hi

(10) Patent No.: US 7,698,972 B2
(45) Date of Patent: Apr. 20, 2010

(54) MULTI-ANGLE TOOL HANDLE

(76) Inventor: Fanny Hi, No. 16, Lane 63, Lising St., Yilan City, Yilan County (TW)

( * ) Notice: Subject to any disclaimer, the term of this patent is extended or adjusted under 35 U.S.C. 154(b) by 0 days.

(21) Appl. No.: 12/042,455

(22) Filed: Mar. 5, 2008

(65) Prior Publication Data

US 2009/0223328 A1 Sep. 10, 2009

(51) Int. Cl.
*B25B 23/16* (2006.01)
*B25G 1/00* (2006.01)

(52) U.S. Cl. ..... 81/177.8; 81/177.7

(58) Field of Classification Search ..... 81/177.8, 81/177.5–177.7
See application file for complete search history.

(56) References Cited

U.S. PATENT DOCUMENTS

| | | | | | |
|---|---|---|---|---|---|
| 579,277 | A * | 3/1897 | Lord et al. | 403/96 |
| 3,773,094 | A * | 11/1973 | Kuenzel | 81/177.9 |
| 4,787,276 | A | 11/1988 | Condon | |
| 5,802,936 | A * | 9/1998 | Liu | 81/450 |
| 5,943,921 | A * | 8/1999 | Lin | 81/59.1 |
| 5,943,925 | A * | 8/1999 | Huang | 81/177.2 |
| 6,145,413 | A * | 11/2000 | Lin | 81/63.1 |
| 6,186,033 | B1 * | 2/2001 | Faro, Sr. | 81/177.7 |
| 6,401,576 | B1 * | 6/2002 | Wu | 81/177.4 |
| 6,848,344 | B2 * | 2/2005 | Rocco | 81/177.8 |
| 7,047,846 | B1 * | 5/2006 | Hu | 81/177.7 |
| 7,174,810 | B1 * | 2/2007 | Lin | 81/63.1 |
| 7,246,545 | B1 * | 7/2007 | Lee | 81/177.9 |
| 7,287,450 | B1 * | 10/2007 | Liao | 81/177.9 |
| 7,302,876 | B1 * | 12/2007 | Lee et al. | 81/177.9 |
| 7,343,837 | B1 | 3/2008 | Domanico et al. | 81/177.7 |
| 7,415,911 | B2 * | 8/2008 | Cole et al. | 81/177.8 |
| 2007/0251357 | A1 | 11/2007 | Hsieh | 81/177.9 |

FOREIGN PATENT DOCUMENTS

| | | | |
|---|---|---|---|
| DE | 29616736 | U1 | 11/2007 |
| EP | 1512498 | A1 | 3/2005 |
| TW | 279461 | | 11/2005 |

* cited by examiner

*Primary Examiner*—David B Thomas
(74) *Attorney, Agent, or Firm*—Alan Kamrath; Kamrath & Associates PA

(57) ABSTRACT

A multi-angle tool handle includes a handle device including a compartment longitudinally formed therein, and a through-hole formed thereon and in communication with the compartment. An embedding portion is defined in the compartment. A interconnecting element is disposed in the compartment and includes a pivoting end formed on an end thereof and having an embedding portion. A locking device is installed in the through-hole and includes an embedded end defined on an end thereof. A connecting device is pivotally coupled to another end of the interconnecting element. The locking device is moveable between a first position and a second position so that the connecting device can be operated to pivot relative to the handle device or not.

16 Claims, 10 Drawing Sheets

MULTI-ANGLE TOOL HANDLE

BACKGROUND OF THE INVENTION

1. Field of the Invention

The present invention relates to a multi-angle tool handle.

2. Description of the Related Art

A conventional tool handle is shown in Taiwan Patent NO M279461. Specifically, the tool handle includes a handle 1, a driving unit 2, a base cap 3 and a connecting stem 4. A pawl 21 is formed on an end of the driving unit 2 and is disposed in a though-hole 13 which is defined though the handle 1. A pin 31 is formed on the top of the base cap 3 and is adapted for abutting another end of the driving unit 2. A ratchet 42 is defined on an end of the connecting stem 4 adjacent to the driving unit 2. A teeth portion 43 is formed on the periphery of the ratchet 42, with the pawl 21 engaging therewith.

The connecting stem 4 can pivot relative to the driving unit 2 to various angles. However, the connecting stem 4 only can be fixed to a specific position for stable operation by using a spring to maintain positioning of the driving unit 2.

The present invention is therefore intended to obviate or at least alleviate the problems encountered in the prior art.

SUMMARY OF THE INVENTION

Accordingly, an object of the present invention is achieved by providing a multi-angle tool handle that includes a handle device, an interconnecting element, a locking device and a connecting device. The handle device includes a compartment longitudinally formed therein, a through-hole formed though the top thereof and communicating with the compartment, and an embedding portion defined in the compartment and relative to the through-hole. The interconnecting element includes a first hole formed though an end thereof and further includes an embedding portion formed in the first hole. The locking device is installed in the through-hole of the handle device and the first hole of the interconnecting element. The locking device includes an embedded end corresponding to the embedding portion of the handle device and the embedding portion of the interconnecting device. The connecting device is pivotally coupled to another end of the interconnecting element opposite to the locking device and is adapted for connecting to bits of a tool. When the locking device is in a first position, the embedded end of the locking device engages with the embedding portion of the handle device and the embedding portion of the interconnecting element. When the locking device is in a second position, the embedded end of the locking device engages with the embedding portion of the handle device and disengages from the embedding portion of the interconnecting element.

The primary advantage of the multi-angle tool handle according to the present invention is to provide various shapes for a tool handle for operation so that the user can operate in different conditions and achieve both the purposes of effort-saving and time-saving.

Other advantages and features of the present invention will become apparent from the following description referring to the drawings.

BRIEF DESCRIPTION OF THE DRAWINGS

The present invention will be described via detailed illustration of preferred embodiments referring to the drawings.

DETAILED DESCRIPTION OF THE PREFERRED EMBODIMENTS

Figure 1:
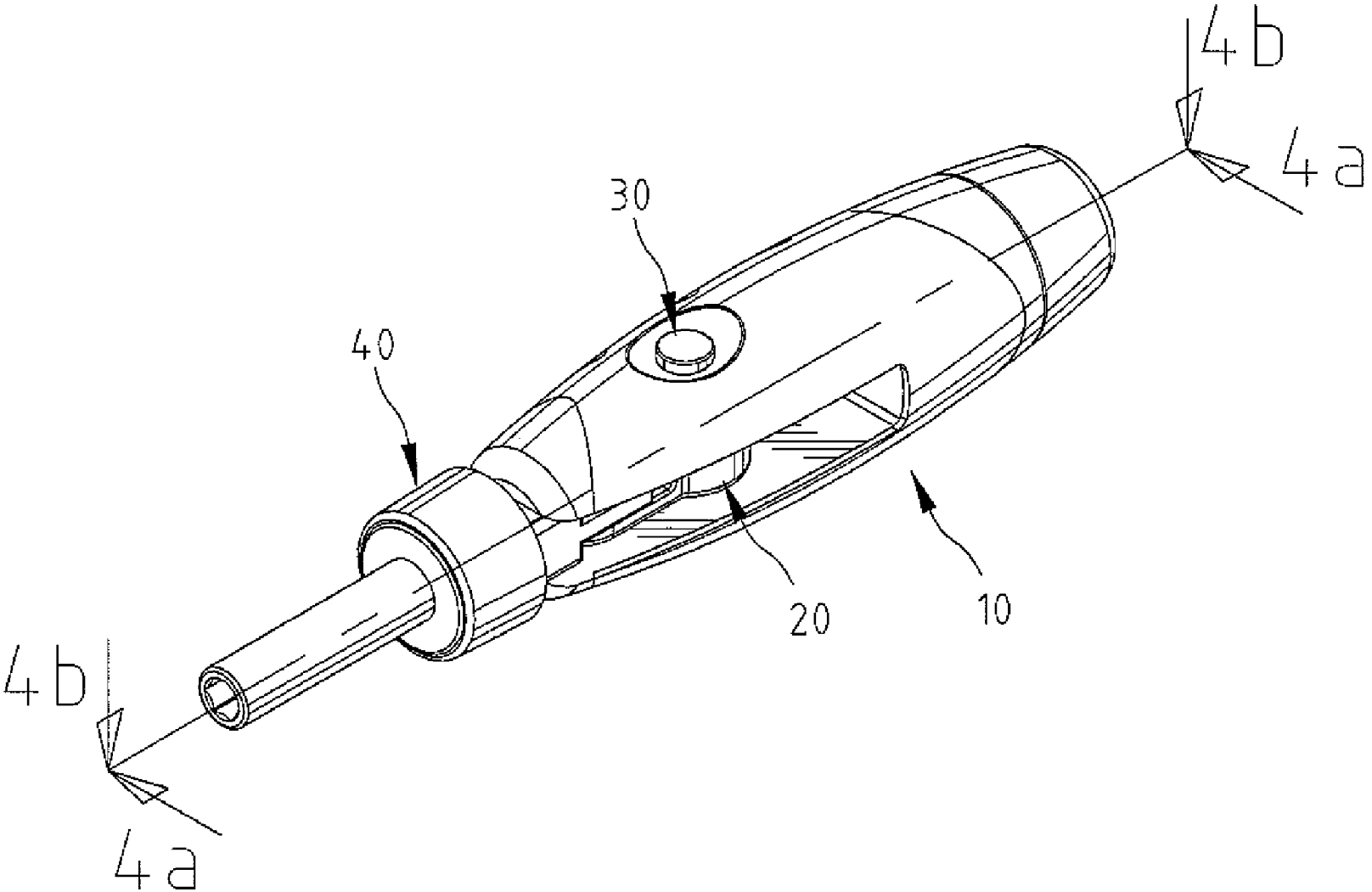
FIG. 1 is a perspective view of a multi-angle tool handle according to the first embodiment of the present invention.
Figure 2:
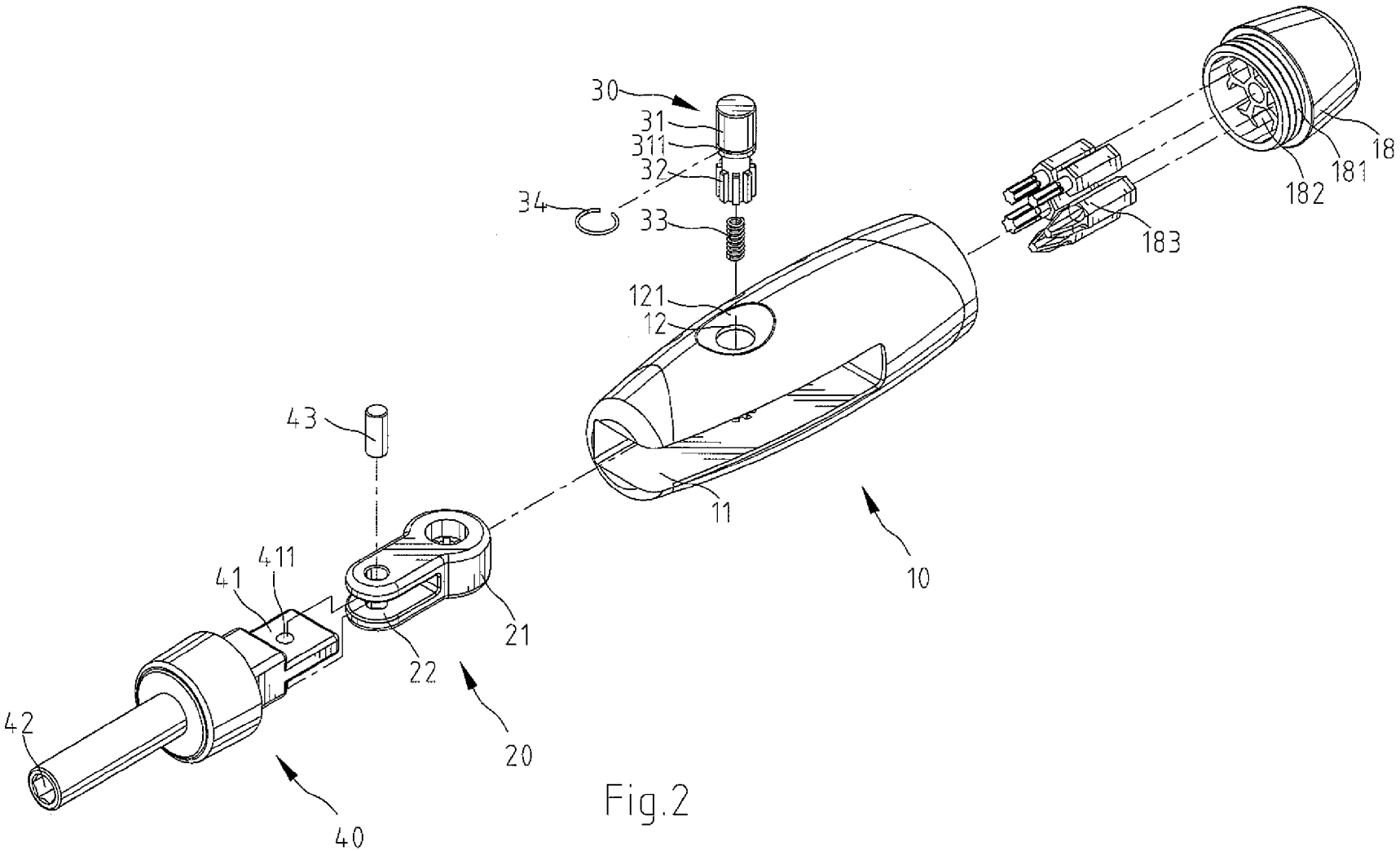
FIG. 2 is an exploded view of the multi-angle tool handle shown in FIG. 1.
Figure 3:
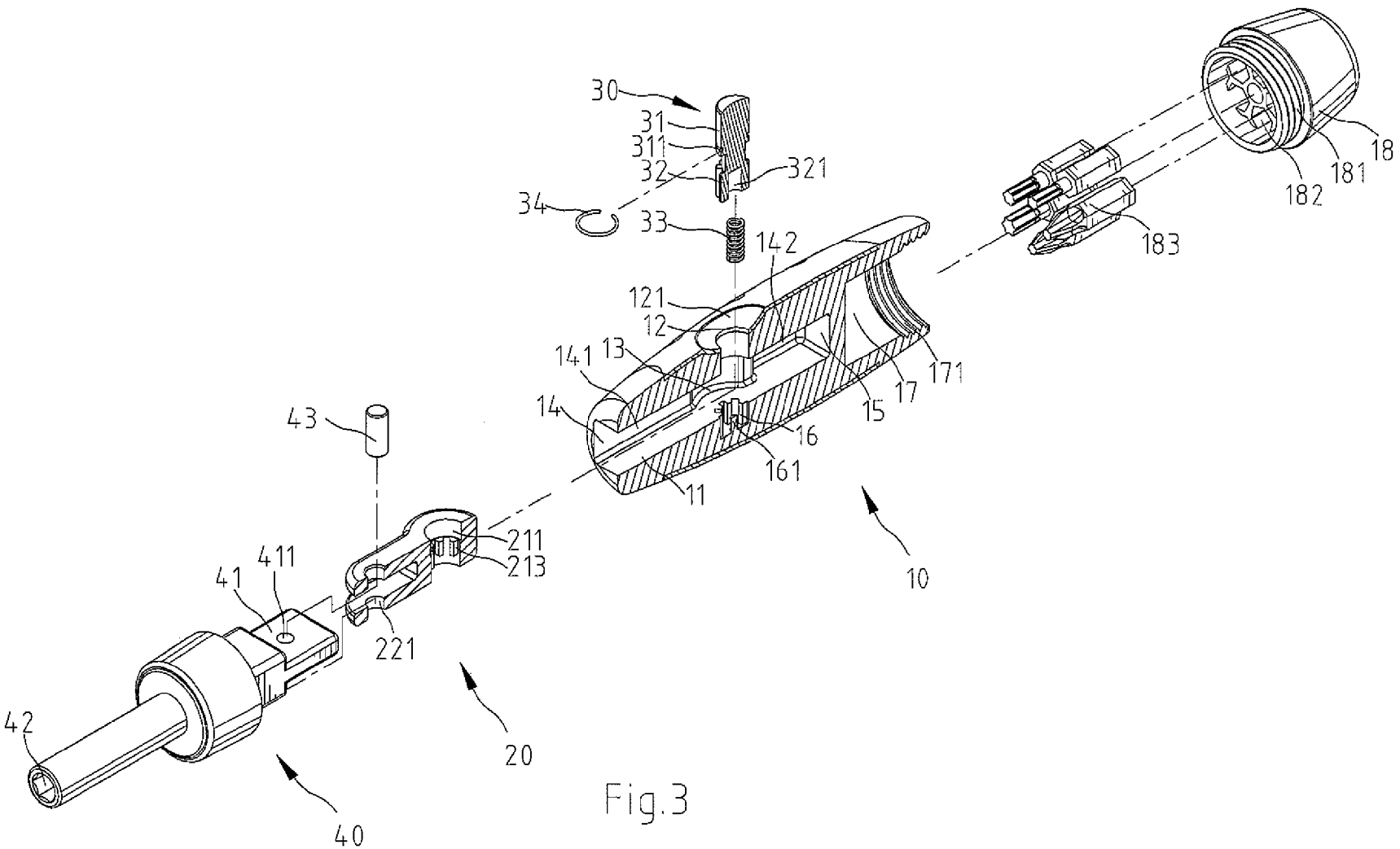
FIG. 3 is a cross-sectional view of the handle device and the interconnecting element of the multi-angle tool handle shown in FIG. 2.

Referring to FIGS. 1 through 3, a multi-angle tool handle in accordance with a first embodiment of the present invention includes a handle device 10, an interconnecting element 20, a locking device 30 and a connecting device 40.

The handle device 10 includes a compartment 11 formed on an end thereof and being open to a side thereof. A through-hole 12 is defined on the top of the handle device 10 and communicates with the compartment 11. First and second inner surfaces 14, 15, respectively, are defined in the compartment 11. A positioning portion 13 is formed on the first inner surface 14 of the compartment 11 and adjacent to the through-hole 12. An embedding portion 16 is defined in the compartment 11 opposite to the through-hole 12. The first inner surface 14 is substantially perpendicular to the second inner surface 15. The positioning portion 13 separates the first inner surface 14 into a first side 141 and a second side 142. An arcuate recess 121 is formed on the top of the handle device 10 and extends from the through-hole 12 for comfortable operation. The embedding portion 16 has a plurality of teeth defined on the inner periphery, and a protrusion 161 is formed from the bottom of the embedding portion 16 and extends toward the through-hole 12. A socket 17 is formed in another end of the handle device 10 opposite to the compartment 11 and does not communicate with the compartment 11. The socket 17 includes an open end and a threaded portion 171 formed in the open end thereof. A cap 18 is installed to the socket 17 and includes a threaded portion 181 for engaging with the threaded portion 171 and a plurality of receiving holes 182 for receiving various kinds of bits 183.

The interconnecting element 20 includes a first end disposed in the positioning portion 13 and a second end connected to the connecting device 40. A round shaped pivoting end 21 is defined on the first end of the interconnecting element 20. Two connecting ends 22 are defined on the second end of the interconnecting element 20 and extend from the pivoting end 21 respectively. One of the connecting ends 22 is parallel to the other connecting end 22, and there is a spacing between the two connecting ends 22. The pivoting end 21 includes a first hole 211 extending therethrough axially and an embedding portion 213 formed on the inner side of the first hole 211, with the embedding portion 213 having a plurality teeth arranged annularly in the first hole 211. A second hole 221 is formed axially through each connecting end 22. The second holes 221 of the two connecting ends 22 are arranged relative to each other.

The locking device 30 is installed in the through-hole 12 of the handle device 10. The locking device 30 includes a pressing portion 31 formed on an end thereof and protruding from the handle device 10. An embedded end 32 is formed on another end of the locking device 30 opposite to the pressing portion 31 and corresponding to the embedding portion 213 of the interconnecting element 20 and the embedding portion 16 of the handle device 10 respectively. An annular groove 311 is defined on the pressing portion 31 adjacent to the embedded end 32. A receiving hole 321 is defined in the embedded end 32 and extends toward the embedding portion 16 of the handle device 10. A fastener 34 is disposed in the annular groove 311, and an elastic element 33 is received in the receiving hole 321. The embedded end 32 is provided for inserting into and engaging with the embedding portion 16. Thus, the elastic element 33, which is disposed between the receiving hole 321 and the protrusion 161, and the fastener 34 that grips on the pressing portion 31 prevent the locking device 30 from disengaging from the handle device 10. Moreover, the elastic element 33 provides the locking device 30 with an outward push force.

The connecting device 40 includes a pivoting end 41 formed on an end thereof and arranged in the spacing between the connecting ends 22 of the interconnecting element 20. A connecting end 42 is defined on another end of the connecting device 40. The pivoting end 41 further includes a pivoting hole 411 corresponding to the second holes 221 respectively. A pin 43 is adapted to be inserted through the second holes 221 and the pivoting hole 411 to allow the connecting device 40 to be pivotally coupled to the interconnecting element 20.

Figure 4A:
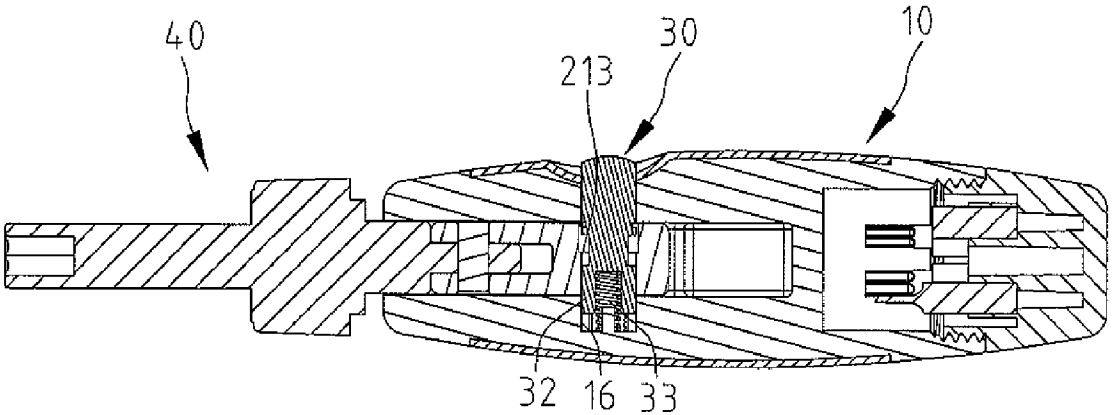
FIG. 4*a* is a cross-sectional view of the multi-angle tool handle taken along a line 4*a*-4*a*, shown in FIG. 1.
Figure 4B:
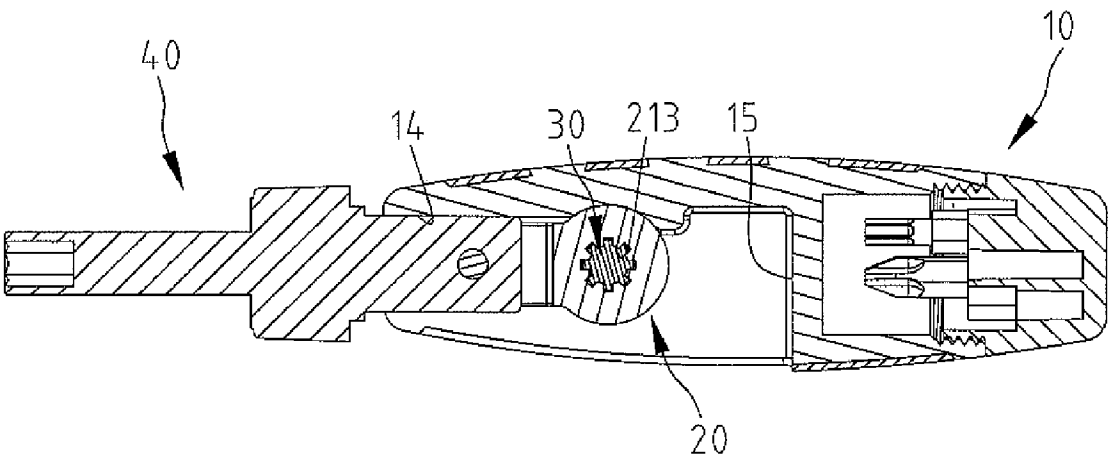
FIG. 4*b* is a cross-sectional view of the multi-angle tool handle taken along a line 4*b*-4*b* shown in FIG. 1.
Figure 5A:
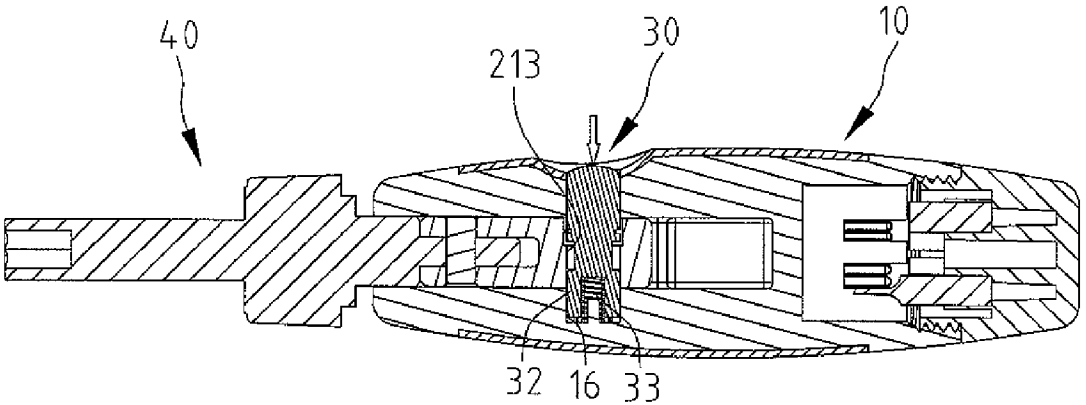
FIG. 5*a* is a cross-sectional view similar to FIG. 4*a*, illustrating the embedded end of the locking device being pressed to engage with the embedding portion of the handle device.
Figure 5B:
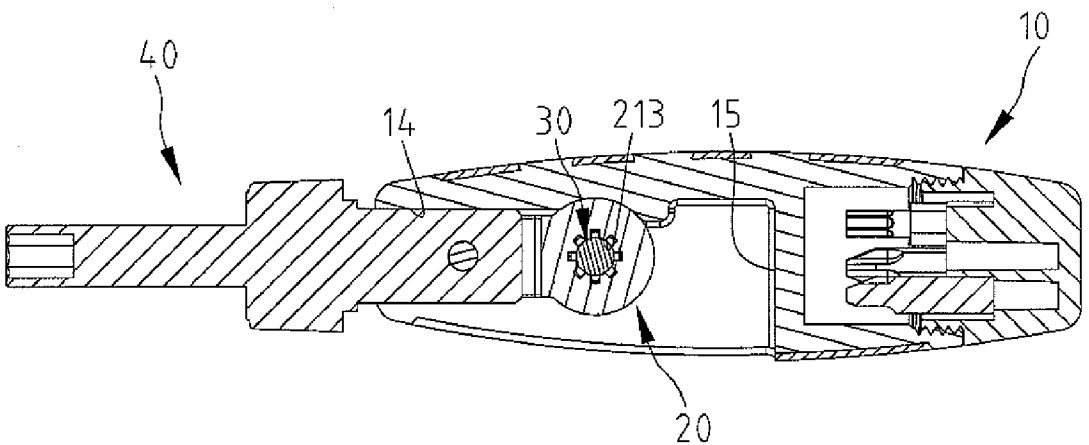
FIG. 5*b* is a cross-sectional view similar to FIG. 4*b*, illustrating the embedded end of the locking device being pressed to engage with the embedding portion of the handle device.

Referring to FIGS. 4 and 5, when the locking device 30 is in a first position (shown in FIG. 4), the pressing portion 31 is not pressed yet. Also, the embedded end 32 engages with both the embedding portion 213 of the interconnecting clement 20 and the embedding portion 16 of the handle device 10. Thus, the interconnecting element 20 can not pivot relative to the handle device 10. When the locking device 30 is in a second position (shown in FIG. 5), the pressing portion 31 is pressed. Also, the embedded end 32 disengages from the embedding portion 213 of the interconnecting element 20 and still engages with the embedding portion 16 of the handle device 10. Therefore, the interconnecting clement 20 can pivot relative to the handle device 10.

Figure 6:
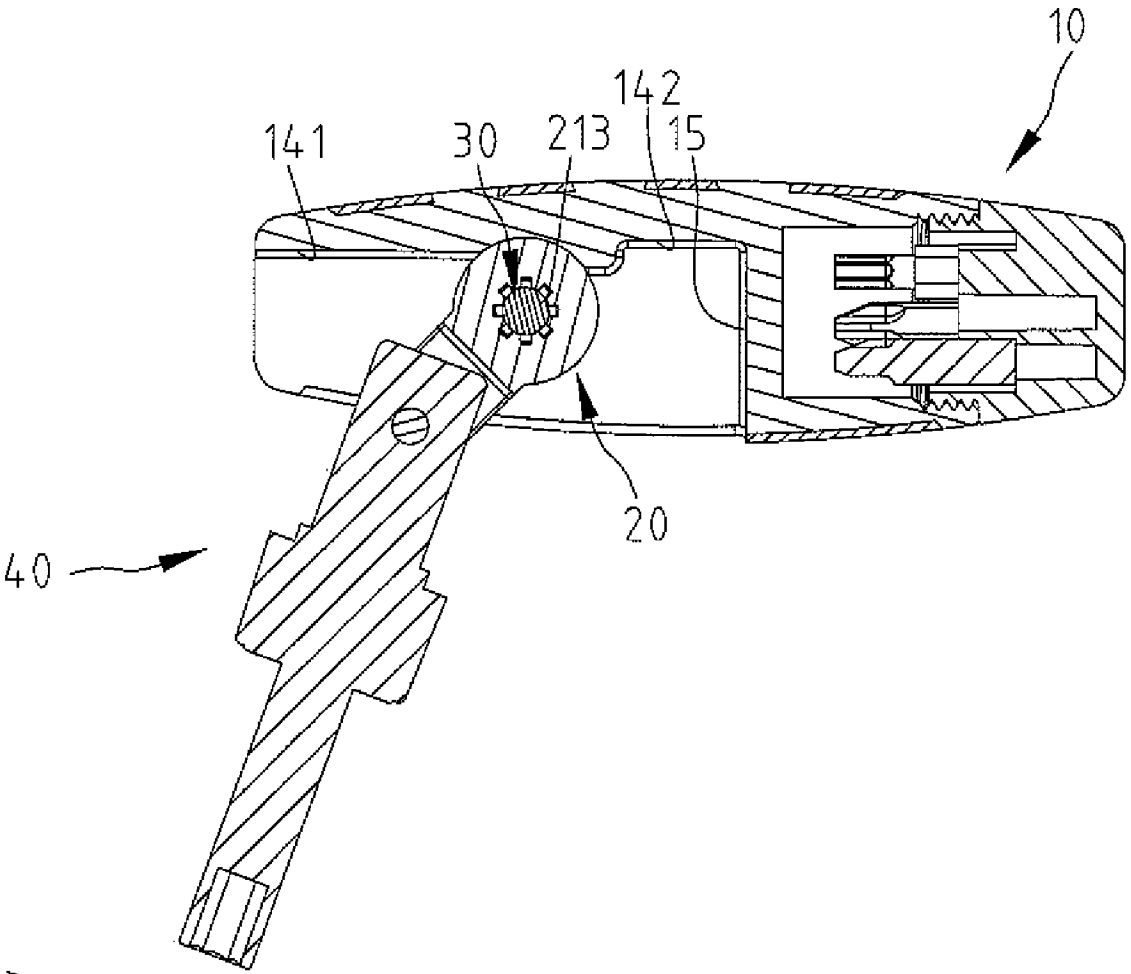
FIG. 6 is a cross-sectional view similar to FIG. 5*b*, illustrating the connecting end driven to pivot relative to the locking device via the interconnecting element.
Figure 7:
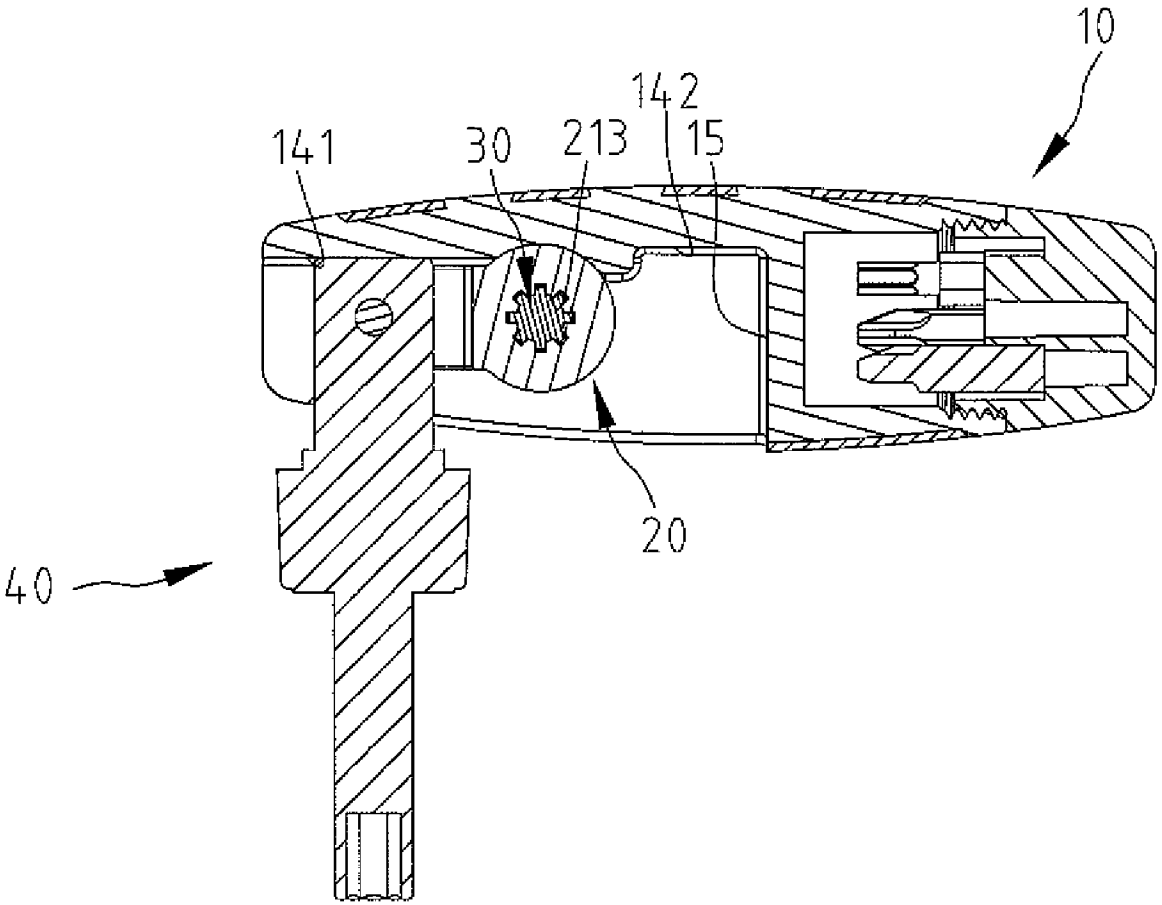
FIG. 7 is another cross-sectional view similar to FIG. 4*a*, illustrating the connecting end fixed to the first position relative to the handle device.
Figure 8:
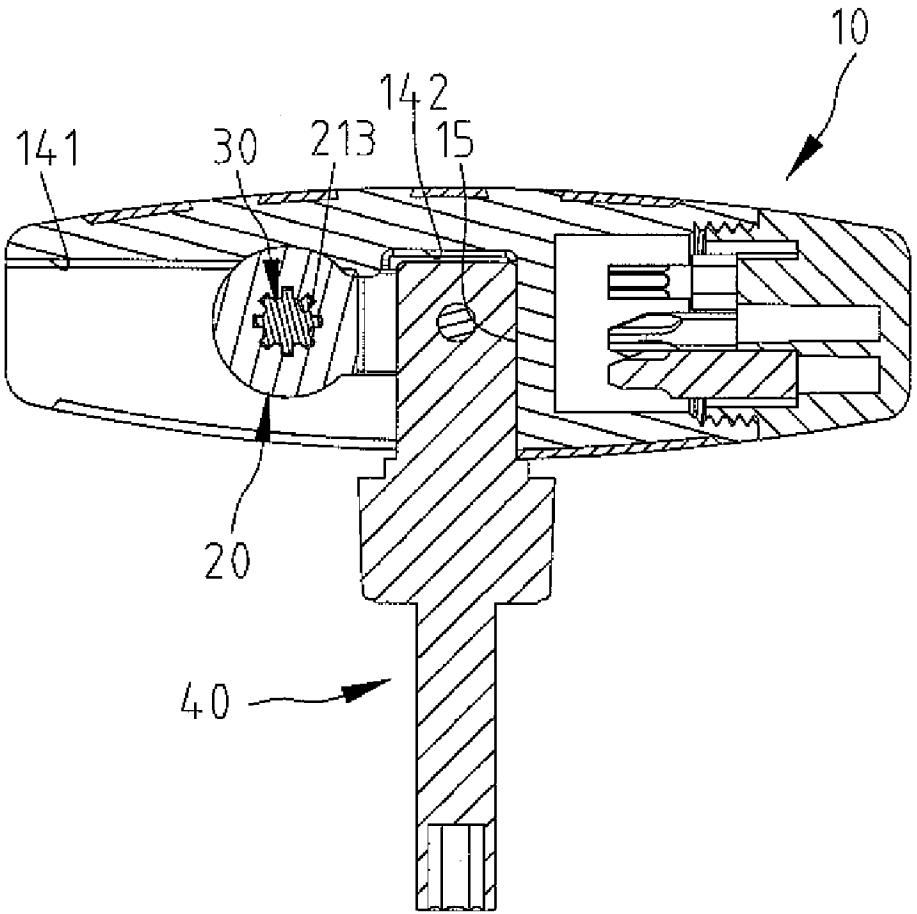
FIG. 8 is another cross-sectional view similar to FIG. 4*a*, illustrating the connecting end fixed to the second position relative to the handle device

Referring to FIGS. 6 through 8, the connecting device 40 is driven by the interconnecting element 20 and pivots relative to the handle device 10 when the locking device 30 is pressed to be in the second position. For general use, a side of the pivoting end 41 of the connecting device 40 abuts with the first side 141 of the first inner surface 14, and the connecting device 40 is parallel to the handle device 10 and the interconnecting element 20 to form the multi-angle tool handle to be I-shaped as shown in FIG. 4.

When the front end of the pivoting end 41 is driven to abut with the first side 141 of the first inner surface 14 by the connecting device 40 pivoting relative the handle device 10, the connecting device 40 is perpendicular to the interconnecting element 20 and the interconnecting element 20 is parallel to the handle device 10 to form the multi-angle tool handle to be L-shaped as shown in FIG. 7. When the pressing portion 31 is not pressed, the elastic element 33 releases to press the embedded end 32 upward to make the locking device 30 return to the first position. In this structure, a user can operate the multi-angle tool handle and achieve the purpose of effort-saving.

When the front end of the pivoting end 41 is driven to abut with the second side 142 of the first inner surface 14 and another side of the pivoting end 41 is driven to abut with the second inner surface 15 by the connecting device 40 pivoting relative the handle device 10, the connecting device 40 is perpendicular to the interconnecting element 20 and the interconnecting element 20 is parallel to the handle device 10 to form the multi-angle tool handle to be T-shaped as shown in FIG. 8. When the pressing portion 31 is not pressed, the elastic element 33 releases to press the embedded end 32 upward to make the locking device 30 return to the first position. In this structure, a user can operate the multi-angle tool handle and achieve both the purposes of effort-saving and time-saving.

Figure 9:
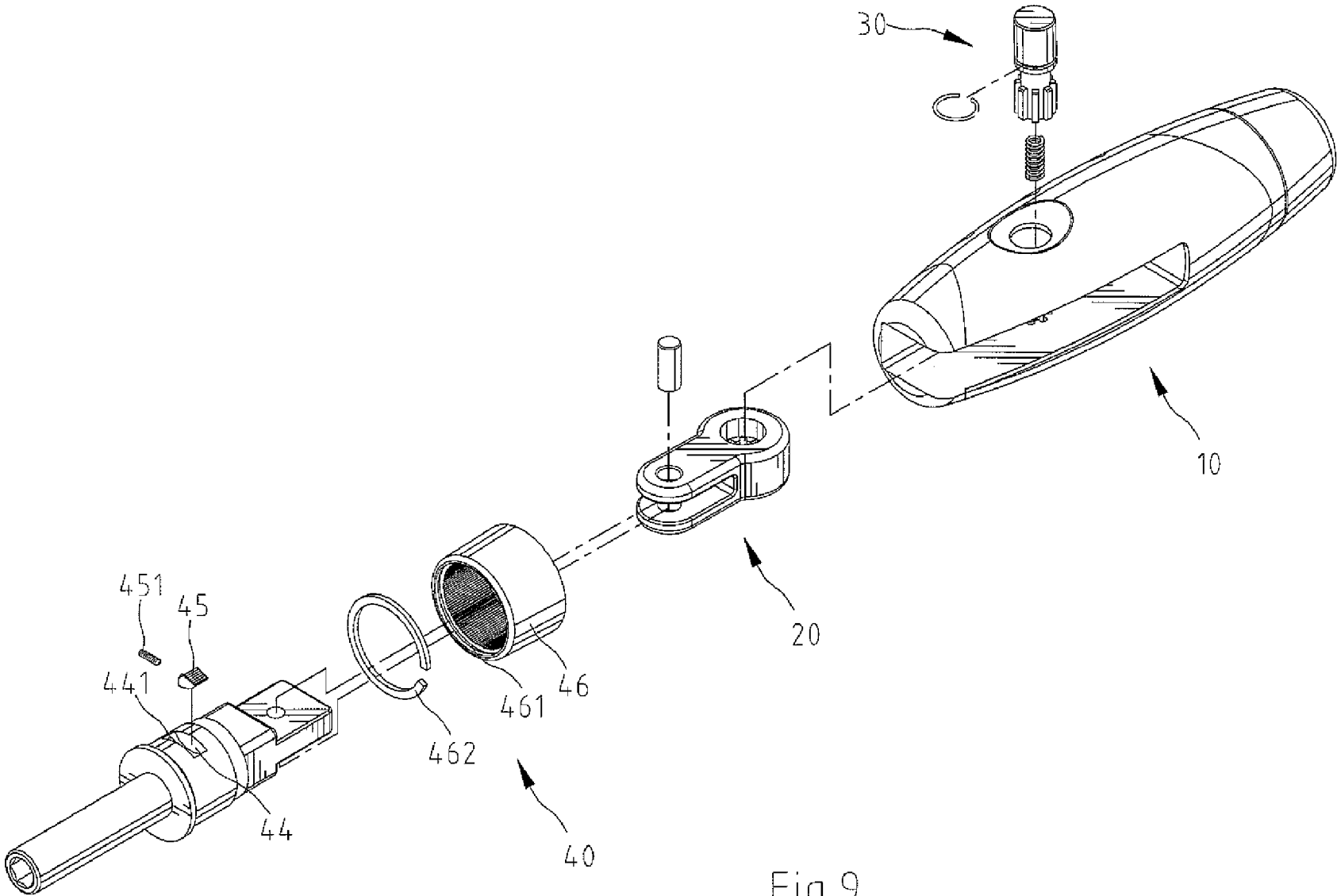
FIG. 9 is a perspective view of a multi-angle tool handle according to a second embodiment of the present invention.
Figure 10:
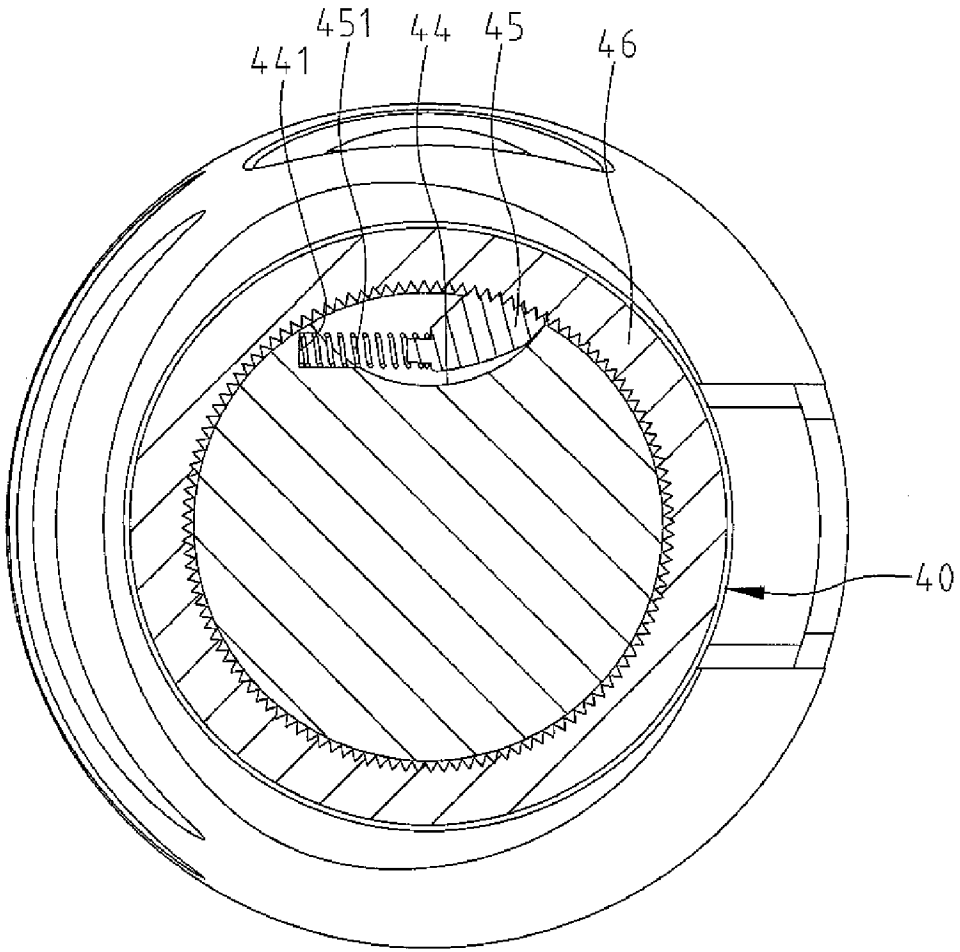
FIG. 10 is a cross-sectional view of the multi-angle tool handle shown in FIG. 9.

Referring to FIGS. 9 and 10, a multi-angle tool handle in accordance with a second embodiment of the present invention is similar to the first embodiment except that the connecting device 40 further includes a cavity 44 defined between the pivoting end 41 and connecting end 42, a pawl 45 and a spring 451 arranged in the cavity 44 and a sheath 46 disposed on the connecting device 40 relative to cavity 44. The cavity 44 has a notch 441 allowing the spring 451 to be disposed thereon. The sheath 46 abuts with the pawl 45 to limit the connecting device 40 to drive in one direction only. Moreover, a C-clip 462 is disposed in a groove 461 that is formed in the sheath 46 so that it prevents the sheath 46 from disengaging from the connecting device 40.

What is claimed is:

1. A multi-angle tool handle comprising:

a handle device including a compartment longitudinally formed therein and open to a side thereof, a through-hole formed on the handle device and in communication with the compartment and an embedding portion defined in the compartment;

an interconnecting element disposed in the compartment and including a pivoting end formed on an end thereof, with the pivoting end having an embedding portion, with the interconnecting element having another end opposite to the end;

a locking device installed in the through-hole and including an embedded end defined on an end thereof with the interconnecting element pivotably coupled to the handle device about a first pivot axis defined by the locking device;

wherein when the locking device is in a first position, the embedded end of the locking device engages with both the embedding portion of the handle device and the embedding portion of the interconnecting element;

wherein when the locking device is in a second position, the embedded end of the locking device engages with the embedding portion of the handle device and disengages from the embedding portion of the interconnecting element; and a connecting device pivotally coupled to the end of the interconnecting element about a second pivot axis spaced from and parallel to the first pivot axis;

wherein the locking device further includes a receiving hole defined in the embedded end and an elastic element disposed between the receiving hole and the embedding portion of the handle device.

2. The multi-angle tool handle as claimed in claim 1, wherein the other end of the interconnecting element includes two connecting ends, with a spacing defined between the two connecting ends for receiving a pivoting end of the connecting device.

3. The multi-angle tool handle as claimed in claim 2, with each connecting end having a second hole, with the pivoting end of the connecting device having a pivoting hole corresponding to said second holes, with a pin coupling said pivoting hole to said second holes and defining the second pivot axis.

4. The multi-angle tool handle as claimed in claim 1, wherein the locking device further includes an annular groove formed thereon and a fastener disposed in the annular groove.

5. The multi-angle tool handle as claimed in claim 1, wherein the handle device further includes a socket formed on another end thereof and a cap coupled to the socket and adapted for storage of various kinds of bits.

6. The multi-angle tool handle as claimed in claim 1 further comprising a cavity formed on the connecting device, a pawl and a spring disposed in the cavity, and a sheath mounted on the connecting device and abutting with the pawl.

7. The multi-angle tool handle as claimed in claim 6, with the sheath forming a grove therein, with a C-clip received in the groove.

8. The multi-angle tool handle as claimed in claim 1, with the embedding portion of the handle device having a plurality of teeth formed on an interior periphery thereof.

9. The multi-angle tool handle as claimed in claim 1, with the embedding portion of the interconnecting element having a plurality of teeth formed on an interior periphery thereof.

10. The multi-angle tool handle as claimed in claim 1, with the embedded end of the locking device having a plurality of teeth formed on an outer periphery thereof.

11. A multi-angle tool handle comprising:

a handle device including a compartment longitudinally formed therein and open to a side thereof, a through-hole formed on the handle device and in communication with the compartment and an embedding portion defined in the compartment;

an interconnecting element disposed in the compartment and including a pivoting end formed on an end thereof, with the pivoting end having an embedding portion, with the interconnecting element having another end opposite to the end;

a locking device installed in the through-hole and including an embedded end defined on an end thereof with the interconnecting element pivotably coupled to the handle device about a first pivot axis defined by the locking device;

wherein when the locking device is in a first position, the embedded end of the locking device engages with both the embedding portion of the handle device and the embedding portion of the interconnecting element;

wherein when the locking device is in a second position, the embedded end of the locking device engages with the embedding portion of the handle device and disengages from the embedding portion of the interconnecting element; and a connecting device pivotally coupled to the end of the interconnecting element about a second pivot axis spaced from and parallel to the first pivot axis, with the compartment having first and second inner surfaces selectively abutting with the connecting device and a positioning portion defined on the first inner surface disposing the pivoting end of the interconnecting element.

12. The multi-angle tool handle as claimed in claim 11, with the positioning portion separating the first inner surface into first and second sides, with the second side adjacent to the second inner surface.

13. The multi-angle tool handle as claimed in claim 12, wherein by operation of the locking device in the second position, the connecting device is positioned as to form the multi-angle tool handle as being L-shaped, with the front end of the connecting device abutting the first side of the first inner surface.

14. The multi-angle tool handle as claimed in claim 12, wherein by operation of the locking device in the second position, the connecting device is positioned as to form the multi-angle tool handle as being T-shaped, with the connecting device abutting the second side of the first inner surface and the second first inner surface respectively.

15. The multiple-angle tool handle as claimed in claim 11 with the pivoting end of the interconnecting element abutting with the positioning portion during pivotal movement of the interconnecting element relative to the handle device.

16. The multiple-angle tool handle as claimed in claim 15 with the positioning portion integrally formed in the compartment of the handle device of a same material which does not allow separation.

* * * * *